United States Patent [19]

Yamada et al.

[11] Patent Number: 4,911,769

[45] Date of Patent: Mar. 27, 1990

[54] COMPOSITE CONDUCTIVE MATERIAL

[75] Inventors: Shuji Yamada; Koji Tsuji; Yoshinobu Takegawa, all of Kadoma; Akira Tanimura, Amagasaki; Akira Menju, Amagasaki; Nobuyoshi Yano, Amagasaki, all of Japan

[73] Assignees: Matsushita Electric Works, Ltd., Osaka; Unitika, Ltd., Hyogo, both of Japan

[21] Appl. No.: 171,700

[22] Filed: Mar. 22, 1988

[30] Foreign Application Priority Data

Mar. 25, 1987 [JP] Japan ..... 62-70683
Mar. 25, 1987 [JP] Japan ..... 62-70694

[51] Int. Cl.[4] ..... C22C 5/02; C22C 5/06; C22C 9/00

[52] U.S. Cl. ..... 148/430; 148/432; 428/614

[58] Field of Search ..... 420/501, 505, 507, 496; 148/430, 431, 432; 428/614, 928

[56] References Cited

U.S. PATENT DOCUMENTS 2,365,249 12/1944 Comstock ..... 420/501
4,279,649 7/1981 Fujiwara et al. ..... 148/431
4,387,073 6/1983 Westbrook ..... 420/507

FOREIGN PATENT DOCUMENTS 0153895 2/1982 Fed. Rep. of Germany ..... 420/507
0147827 7/1986 Japan ..... 420/501
0288032 12/1986 Japan .
0001835 1/1987 Japan .
0077439 4/1987 Japan .

*Primary Examiner*—L. Dewayne Rutledge
*Assistant Examiner*—David W. Schumaker
*Attorney, Agent, or Firm*—Burns, Doane, Swecker & Mathis

[57] ABSTRACT

An electrically conductive composite material is formed by dispersing in a matrix metal another metal which is insoluble or slightly soluble with the matrix metal. The other metal is finely divided to an extent of not excessively lowering the conductivity and is mixed in the matrix metal in a particle amount such that respective particles keep a mutual distance effective to strengthen the composite material. The material is thereby sufficiently improved in the mechanical strength and wear resistance and remarkably reduced in high temperature deformation. Such conductive composite material can be obtained through a melt atomization.

7 Claims, 2 Drawing Sheets

Fig. 3
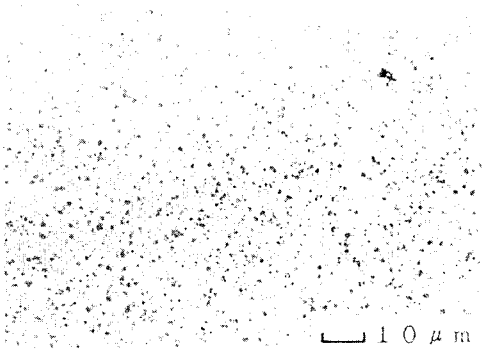
Fig. 4
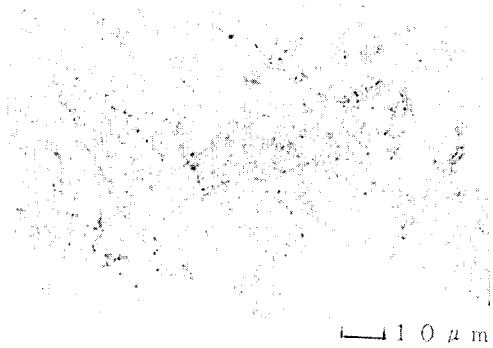
Fig. 5

COMPOSITE CONDUCTIVE MATERIAL

TECHNICAL BACKGROUND OF THE INVENTION

This invention relates to a composite conductive material and, more particularly, to such material in which particles of at least one metal or metalloid are dispersed within a matrix conductive metal for elevating its strength, the metals being mutually insoluble or slightly soluble at a normal temperature, and to a method for manufacturing such composite material, as well as to an electric contact material obtained from the composite conductive material.

The electric contact material obtained from the composite conductive material of the kind referred to can be effectively utilized as electric contacts in such various electric devices and equipment as relays, brakers, power-type relays and the like.

DISCLOSURE OF PRIOR ART

It has been generally practiced to obtain strengthened composite conductive materials by dispersing in such conductive material as Ag, Au, Cu and the like some other metal particles, in which event it has been an issue, from the viewpoint of the strength, at which distance from one another the respective particles of the other metal are to be dispersed in the conductive material. That is, any dislocation caused in the composite material upon application of an external force thereto occurs such that a deformation will take place in the material, while this deformation becomes unlikely to easily take place when the dislocation is made difficult to occur, and the hardness is thereby elevated. An external force $\sigma$ required for causing the dislocation is represented by the formula $\sigma=\mu b/2\pi\lambda$ (in which $\mu$ is the modules of rigidity, b is the bergers factor, and $\lambda$ is the distance between the respective metal particles). When the distance $\lambda$ is made smaller in this formula, the force $\sigma$ becomes larger so that the material will be less deforming responsible to a given dislocation, and a hard composite conductive material can be prepared. To make the distance between the particles smaller, the metal particles to be dispersed may be finely divided and their content may be increased.

There has been suggested in U.S. Pat. No. 3,880,777 to Akira Shibata, on the other hand, an electrical contact material containing, as dispersed in Ag and as internally oxidized, at least two of Zn, Sn and Sb as well as one of Group IIa elements in the Periodic Table added along with Ni or Co, in an attempt to have the contact material provided with both an anti-welding property and low contact resistance, but this contact material has not been satisfactory in attaining a high level strengthening.

Further, in Japanese Patent Laid-Open Publication No. 61-147,827, there have been disclosed an electrical contact material containing, as uniformly dispersed in Ag, Ni particles of 1 to 2Q microns and fine submicron Ni particles, and a method of producing such material. In this contact material, however, the dispersed Ni particles are of such a wide range of size as 1 to 20 microns, so that the distance between the particles cannot be made sufficiently smaller so as not to be capable of decreasing $\lambda$ in the above formula, whereby dislocation can still easily occur and the strength has not been remarkably improved. It has also been found that the particles of 1 to 20 microns and certain submicron particles have been practically unable to simultaneously exist according to such techniques as disclosed in this laid-open publication.

SUMMARY OF THE INVENTION

A primary object of the present invention is, therefore, to provide a composite conductive material which can be made high in hardness but low in viscosity and less deformable at higher temperature, without substantial change in the electric properties, to provide a method for manufacturing such a material, and further to provide an electric contact material of the composite conductive material.

According to the present invention, this object can be attained by providing a composite conductive material formed by dispersing in a matrix metal another metal which is insoluble or slightly soluble at a normal temperature with the matrix metal for strengthening the material, wherein the other metal is at least one metal or metalloid of a particle size of 0.01 to 1 $\mu$m and at a ratio of 0.5 to 20 wt % of the total weight of the matrix metal and the other metal.

Other objects and advantages of the present invention shall be made clear in the following description of the invention detailed with reference to preferred examples in conjunction with the accompanying drawing.

BRIEF EXPLANATION OF THE DRAWINGS

FIG. 3 is a microscopic photograph of the material according to the present invention; and FIGS. 4 and 5 are microscopic photographs of referential examples.

Figure 1:
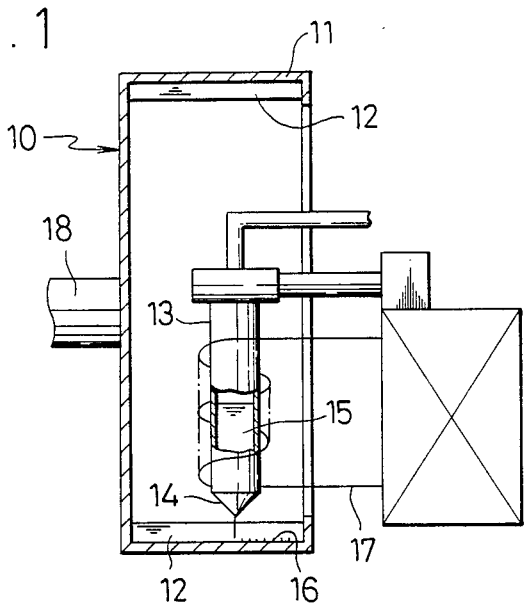
FIG. 1 is a schematic sectioned view of a device employed for a rotating water atomization in the method for manufacturing the composite conductive material according to the present invention.

While the present invention will be detailed in the following with reference to the preferred examples, it should be appreciated that the intention is not to limit the invention only to such examples but rather to include all modifications, alterations and equivalent arrangements possible within the scope of the appended claims.

DISCLOSURE OF PREFERRED EXAMPLES

In the composite conductive material according to the present invention, there is dispersed in a matrix metal A a metal B which is insoluble or slightly soluble at a normal temperature with the matrix metal A. In other words, this metal B insoluble or slightly soluble at the normal temperature with the matrix metal is to be one which does not form a uniform solid phase with the matrix metal A, that is, any solid solution, at a normal temperature, while is not limited to be one that can never form a solid solution, but is to include one which is low in solid solubility. Further, while it is not restricted, it is preferable that the matrix metal A and the other metal B will be in a uniform liquid phase in their molten state, since the other metal B is then adapted to become uniformly dispersed as finely divided within the matrix metal A when they revert to the solid phase.

For the matrix metal A, Ag is to be employed but Au or Cu appears to be also employable. The other metal B may be selected in various manners depending on the matrix metal A employed and, while not specifically limited, Ni, Fe and Co may suitably be employed as the other metal B when the matrix metal A is, for example, Ag, and such others as Cr, Si, Rh and V appear also employable. In all events, at least one metal selected from these groups can be employed as the other metal B. When the matrix metal A is Au, at least one metal selected from the group consisting of Ge, Si, Sb and Rh appears employable as the other metal and, when the matrix metal A is Cu, the other metal B should preferably be Fe. With such combination of the matrix metal A and the other metal B as herein referred to, the dispersion of the other metal B will be made fine and uniform.

It is necessary that the amount of the other metal B to be dispersed is made to be 0.5 to 20 wt %, optimally 1 to 10 wt %, of the total weight of the matrix metal A and the other metal B. When the amount of the other metal B is less than 0.5%, the amount of dispersed particles becomes less, so as to render the mutual distance between the particles larger, and thereby to lower the metal strengthening action. When the amount of the other metal B exceeds 20%, the amount of any larger particles which are independent and do not finely disperse increases.

It is also necessary that the other metal B is dispersed in the matrix metal A in the form of particles of a size 0.01 to 1 μm, because with a particle size below 0.01 μm the conductivity of the matrix metal A tends to decrease, while a size over 1 μm deteriorates the metal strengthening action due to the dispersion. In practice, however, there arises no substantial problem even when particles of the other metal B of a size above 1 μm and below 5 μm are mixed, so long as they are less than about 5 wt % of the entire metal B dispersed in the particles of the matrix metal A.

According to a feature of the present invention, further, the composite conductive material can be prepared in a powder in which the metal B particles which do not form any solid solution in the matrix metal A are uniformly, and finely dispersed by melting the matrix metal A and the other metal B not forming any solid solution with the metal A at atmospheric temperature, and mixing them with each other, rapidly cooling to solidify them. Here, it is preferable that a melt of the matrix metal A and the other metal B will be rapidly cooled to solidify at a cooling rate of more than $10^{4°}$ C./sec. For such rapid coiling and solidifying, there are enumerated a rotating water atomization, high pressure gas atomization, water jetting, belt conveying, cavitation and the like methods. In using, in particular, a composite conductive material of uniformly spherical powder, rotating water atomization should preferably be employed, while high pressure gas atomization of a higher cooling rate is preferable in obtaining a high quality composite conductive material. Rotating water atomization is a method employing a rotating water spinning device for fabricating amorphous metal fiber, in which the molten state metals admixed are jetted against an inner peripheral wall of a rotary drum on which wall a filmy water layer is spread so as to have the metals rapidly cooled and solidified as powder.

Referring more specifically to the rapid cooling and solidification, it is required, for obtaining the cooling rate of more than $10^{4°}$ C./sec. by the high pressure gas atomization, to provide a nozzle hold diameter small enough to control the atomization gas pressure at a higher level. Preferably, the nozzle hole diameter for the molten metal jetting is set to be below 7 mm, more preferably below 5 mm, or optimally below 3 mm. When the diameter exceeds 7 mm, the cooling rate of more than $10^{4°}$ C./sec. becomes difficult to obtain so that, in the thus obtained composite conductive material, there will arise a tendency that larger size particles of the other metal B in a single phase are present and their dispersibility is decreased. The atomization gas pressure should preferably be more than 20 kg/cm$^2$, more preferably above 30 kg/cm$^2$ and, optimally, more than 50 kg/cm$^2$. When the pressure is less than 25 kg/cm$^2$, there arises a tendency that the cooling rate of more than $10^{4°}$ C./sec. is difficult to obtain so that the obtained composite conductive material tends to contain larger size particles of the metal B in a single phase, thereby decreasing the dispersibility of the particles. It is preferable that an inert gas is employed as the high pressure atomization gas.

For the temperature of melt, that is, the molten state of the metals A and B, it is necessary to keep the temperature higher than the melting point of the other metal B. When nozzle clogging prevention as well as uniform dispersion in the melt are taken into account, preferably the temperature will be higher than 100° C. or more preferably higher than 200° C.

In the case of attaining the cooling rate of more than $10^{4°}$ C./sec. in the rotating water rotating water atomization, the nozzle hole diameter should also be properly selected. That is, the nozzle hole diameter for jetting the melt of the metals should preferably be 0.05 to 0.5 mm, more preferably 0.07 to 0.3 mm or, optimally, 0.1 to 0.2 mm. When the size is larger than 0.5 mm, the cooling rate of more than $10^{4°}$ C./sec. is difficult to attain so that the obtained composite conductive material will contain larger size particles of the metal B in a single phase and thus decrease the dispersibility of the particles. When the size is smaller than 0.05 mm, on the other hand, the nozzle hole easily closes.

Further, the flow rate of the cooling water should preferably be more than 200 m/min., more preferably more than 300 m/min. or, optimally, more than 400 m/min. Since the cooling rate of more than $10^{4°}$ C./sec. is difficult to attain with a flow rate lower than 200 m/sec. such that the obtained composite conductive material will contain larger size particles of the metal B in a single phase to decrease the dispersibility of the particles. The temperature of the melt of metals should preferably be higher by more than 100° C. than the melting point of the other metal B or, optimally, by more than 200° C.

In increasing the cooling rate, the cooling water is at a temperature below 10° C. or, optimally, below 4° C. In this case, the nozzle hole and cooling water should preferably be at a distance less than 10 mm or, optimally, less than 5 mm. Further, the melt of metals is jetted toward the cooling water at an angle of preferably more than 20° with respect to the surface of the cooling water or, optimally, more than 60°.

In order that the other metal B is dispersed more finely and uniformly, the melt of metals may be subjected to an agitation, in which event a measure may be taken whereby a high frequency coil is provided about the outer surface of the nozzle for causing the melt inside the nozzle to be subjected to an agitation and to a high frequency heating, or to an ultrasonic oscillation for restraining any two phase separation. Another measure may be taken by providing inside the nozzle another coil for the melt agitation so as to adjust the two phase separation of the metal B. It is also effective to provide within the nozzle at a position downstream of the agitating coil and the nozzle hole, a dam or a ceramic filter, so as to restrain any segregation of alloy components in the melt.

The rotating water atomization shall be explained in greater detail as follows. In manufacturing Ag—4.6 wt % Ni alloy powder, Ag and Ni are put in a graphite crucible at a ratio of Ag 95.4 wt % and Ni 4.6 wt % and made to be at a melting temperature of 1,650° C. by means of a high frequency melting. The resulting melt is then jetted out of a nozzle hole of a diameter 0.1 to 0.2 mm into a water film formed on the inner peripheral wall of a rotary drum.

Figure 2:
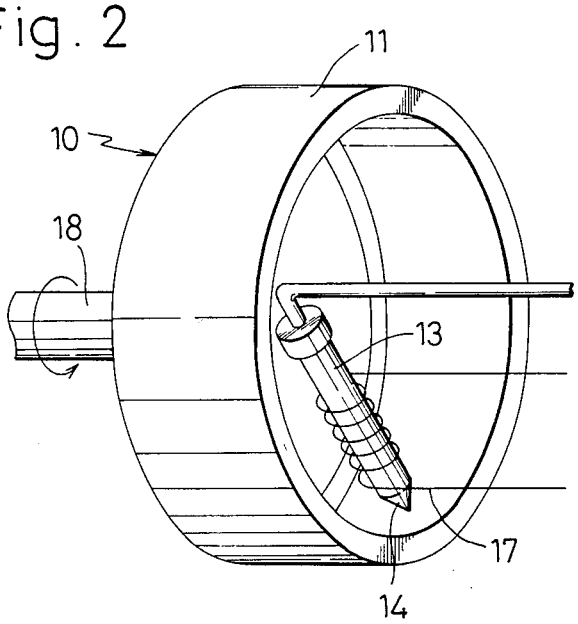
FIG. 2 shows the device of FIG. 1 in perspective view.

In FIGS. 1 and 2, there is shown an example of the device employable for the rotating water atomization, in which the device denoted by 10 comprises rotary drum 11, and a filmy cooling fluid 12 which is formed on the inner peripheral wall of the drum 11 due to the centrifugal force caused by rotation of the drum about its longitudinal axis. The matrix metal A and the other metal B are placed in a jetting furnace 13 having a nozzle 14 and formed therein into a melt 15, and this melt 15 is jetted out of the nozzle 14 into the cooling fluid 12 to be thereby rapidly cooled to form powder 16. The furnace 13 is provided with a heating coil 17 so that a desired temperature will be attained in the furnace, while an axial driving means 18 is coupled to the rotary drum 11 for imparting a desired rotating speed.

It has been found that, with the rotating water atomization employing such device as above, Ni particles of about 0.5 μm are uniformly dispersed in Ag of the solidified powder obtained by rapidly cooling Ag—4.6 wt % Ni.

While in the above the composite conductive material has been referred to as being obtained in the powdery state, it is of course possible to obtain it in any other state than the powdery state, such as strip, wire, fibrous and the like states, without limiting the form of product.

In the composite conductive material thus obtained according to the present invention, the other metal B is dispersed extremely finely and uniformly within the matrix metal A, whereby the material is provided with a high level of hardness so as not to be susceptible to deformation and to have remarkably lower mutual viscosity between pieces of the same material. While, further, the hardness of the material at normal temperature is made high to lower the wearability, there has been seen no deterioration in the electrical properties as compared with conventional materials. In this case, the electrical properties vary in dependence on the electric conductivity and content of the other metal B dispersed in the matrix metal A. With the metal B particles of a size about 0.01 to 1 μm and dispersed at a rate of 0.5 to 20 wt % with respect to the total weight of both the metals A and B, however, there has been seen no substantial influence on the electrical conductivity. Accordingly, the composite conductive material according to the present invention should find a wide range of use, such as electric parts, conductive pastes and so on.

In particular, the composite conductive material can be used to make an electric contact material by forming the composite material into any desire configuration. To this end, optimally, the composite conductive material is hot-pressed and sintered when the material is in powdery form, and the sintered material is then subjected to a wire drawing through a hot-extrusion device so as to form the electric contact material, while any other forming technique may be employed. The electric contact material thus obtained in a wire form through wire drawing may be formed into any desired shape by means of a header or the like, so as to be the electric contact. Of course, the shape of the electric contact material is not limited to one of wire, but may be any other as desired. Instead of the particulate powder as in the above, any other mode of the composite conductive material, for example, wire or strip shape may suitably be employed for obtaining the electric contact material. When the contact material is prepared from the wire strip-shaped composite material, the sintering step may be omitted and only a cutting or punching step may suffice.

In the case of the composite conductive material obtained through the rapid cooling solidification of the melt of Ag—4.6 Ni, consisting thus of Ag 95.4 wt % and Ni 4.6%, according to the present invention, as will be clear in view of the microscopic photograph of FIG. 3, Ni particles are uniformly dispersed in Ag while keeping a sufficient mutual distance λ, so as to attain a high level strengthening of the material.

In a composite conductive material prepared from a mixture of 95 wt % Ag powder of 0.07 μm and 5 wt % Ni powder of 0.02 μm by forming, hot-pressing and sintering as already mentioned, a microscopic photograph of FIG. 4 of this material shows that many of Ni particles cohere to reach a size of 1 to 10 μm so that a favorable mutual distance cannot be attained any more, to render the strengthening insufficient. In a further microscopic photograph in FIG. 5 of a composite material prepared from Ag—5 Ni of a particle size of several σm to 50 μm, it is seen that more larger Ni particles than in the case of FIG. 4 are present so that the mutual distance is further decreased to render the strengthening of the material impossible.

Examples in which the present invention is practiced shall now be referred to as follows.

EXAMPLE 1

Ag and Ni were put in a graphite crucible at a ratio of Ag 95 wt % and Ni 5 wt %, and were subjected to a melting temperature of 1,650° C. by means of a high frequency melting. The thus obtained melt was jetted out of a hole of a diameter of 120 μm of a ruby-made nozzle under an argon back pressure of 4.5 kg/cm$^2$, into a water film at 4° C. formed on the inner peripheral wall of a drum of a diameter of 600 mm and rotated at 500 rpm. This jetting angle formed by the water film and jetted melt was made at 60°, and the nozzle's tip end was at a distance of 4 mm from the water surface, whereby a powdery composite conductive material of a particle size 100 to 200 μm was prepared and the material was annealed in an Ar atmosphere at 850° C. for 3 hours.

EXAMPLE 2

Ag and Ni were put in a graphite crucible at a ratio of Ag 90 wt % and Ni 10 wt %, and were converted to a melt 1,750° C. by means of a high frequency melting. The thus obtained melt was jetted out of a hole of a diameter of 3 mm of a ruby-made nozzle under an argon back pressure of 1 kg/cm$^2$, such jetted melt flow then being atomized with a high pressure argon gas of 70 kg/cm$^2$ (high pressure gas atomization), and the thus obtained rapid-cooled and solidified powder was then annealed in the same manner as in Example 1.

EXAMPLES 3 TO 6.

The procedure of Example 1 was followed, except that Ag as the matrix metal A and Ni as the other metal B were replaced by such metals as listed in TABLE I below, at such ratios also as listed in TABLE I, the powdery composite conductive material thus obtained then being annealed.

COMPARATIVE EXAMPLE 1

Ag powder and Ni powder of less than 350 mesh were mixed at the ratio shown in TABLE I, the mixture was placed in a metal die heated to 400° C. and formed under a pressure of 10 ton/cm$^2$, and the thus formed product was annealed for 3 hours in an Ar atmosphere kept at 850° C.

COMPARATIVE EXAMPLES 2 to 4

The procedure of EXAMPLE 1 was followed, except that Ag as the matrix metal A and Ni as the other metal B were replaced by such metals as listed in TABLE I at such ratios as also shown therein, the powdery composite conductive materials thus obtained then being annealed in the same manner as in EXAMPLE 1.

With respect to the respective annealed powders and materials through these EXAMPLES AND COMPARATIVE EXAMPLES, measurements of the hardness were carried out with a micro-Vickers hardness meter, while applying a load of 100 g for 15 seconds, with the resulting measurements as listed also in TABLE 1.

TABLE I

| | Comp. A:B | Content (wt %) | Particle Size (μm) | Hardness (Hv) |
|---|---|---|---|---|
| EX. 1 | Ag:Ni | 95:5 | 0.5 | 55 |
| EX. 3 | Ag:Ni | 99:1 | 0.5 | 50 |
| Ex. 4 | Ag:Fe | 99:1 | 0.7 | 45 |
| EX. 5 | Ag:Fe | 99:10 | 0.6 | 60 |
| EX. 6 | Ag:Co | 99:5 | 0.6 | 50 |
| COMP. | | | | |
| Ex. 1 | Ag:Ni | 95:5 | 1–20 | 28 |
| EX. 2 | Ag:Ni | 99.9:0.1 | 0.5 | 30 |
| EX. 3 | Ag:Ni | 75:25 | 0.5 | 40 |
| EX. 4 | Ag:Fe | 99.9:0.1 | 100–200 0.2 | 30 |

As is clear in view of the above TABLE 1, the composite conductive materials according to the present invention are high in hardness, and no metal B particles of a size larger than 1 μm are present therein. On the other hand, the composite compound materials according to COMPARATIVE EXAMPLES were low in hardness and, specifically in the case of COMPARATIVE EXAMPLE 3, there were present mixedly smaller particles of 0.05 μm and larger particles of 100–200 μm so that sufficient hardness could not be attained.

With respect to the materials obtained by EXAMPLE 1 and COMPARATIVE EXAMPLE 1, measurements of the Vicker's hardness under high temperature conditions were carried out, and such results as shown in the following TABLE I-a were obtained, the conditions for the measurement having been a load of 1 kg and a time of 15 seconds.

TABLE I-a

| | 25° C. | 300° C. | 500° C. | 700° C. |
|---|---|---|---|---|
| EXAMPLE 1 | 65 | 40 | 24 | 12 |

TABLE I-a-continued

| | 25° C. | 300° C. | 500° C. | 700° C. |
|---|---|---|---|---|
| COMP. EX. 1 | 30 | 20 | 12 | 7 |

It is evident from the above that the material according to the present invention has been improved also in the hardness at higher temperatures, because of the dispersion in Ag of Ni particles in a uniform and fine manner.

EXAMPLES 7 to 9 & COMPARATIVE EXAMPLES 5–7

Ag and Ni were put in a graphite crucible at a ratio of Ag 95 wt % and Ni 5 wt % and melted at a melting temperature of 1,650° C. The resultant melt was jetted out of such nozzle diameters and cooling water flow rates as shown in TABLE II, under argon back pressure 4.5 kg/cm$^2$ into water film at 4° C. formed on the inner peripheral wall of a rotating drum of a diameter 600 mm, and at a jetting angle of 60° formed by the jetted melt and water film surface, while the nozzle's tip end was at a distance of 4 mm from the water surface. The thus obtained composite conductive materials were annealed at 850° C. for 3 hours.

The hardness of the thus obtained material as annealed, as well as the particle size of the Ni particles dispersed in Ag, were measured. The results of which have been as listed in the following TABLE II.

TABLE II

| | Nozzle Hole Dia. (mm) | Cooling Fluid Flow Rate (m/min) | Ni Particle Size (μm) | Hardness (Hv) |
|---|---|---|---|---|
| EX. 7 | 0.10 | 680 | 0.3 | 50 |
| EX. 8 | 0.24 | 980 | 0.4 | 53 |
| EX. 9 | 0.17 | 860 | 0.6 | 57 |
| COMP. | | | | |
| EX. 5 | 0.03 | 700 | — | — |
| EX. 6 | 0.15 | 160 | 2–30 | 35 |
| EX. 7 | 0.7 | 830 | 3–40 | 31 |

As is clear from the above TABLE II, the composite conductive materials are high in hardness, and there was contained substantially no Ni particles as the other metal B of a size larger than 1 μm. In COMPARATIVE EXAMPLE 5, on the other hand, the nozzle hole diameter 0.03 mm was too small and its clogging took place so as not to be able to obtain any material. In the case of COMPARATIVE EXAMPLES 6 and 7, Ni particles of 2 to 40 μm were made to disperse while certain single phase Ni particles in a range of 40 to 300 μm were also produced, and only insufficient hardness could be gained.

EXAMPLES 10 & 11 & COMPARATIVE EXAMPLES 8 & 9

90 wt % of Ag and 20 wt % of Ni were put in the graphite crucible, and made into a melt at 1,750° C. by high frequency melting. The melt was jetted out of a ruby-made nozzle hole of such diameters and jetting gas pressures as listed in the following TABLE III, under an argon back pressure of 1.0 kg/cm$^2$, to form the composite conductive materials, which were than annealed at 850° C. for 3 hours within an Ar atmosphere.

The hardness of the annealed materials and Ni particle size dispersed in Ag were measured, the results of which were listed in the following TABLE III.

TABLE III

| | Nozzle Hole Dia. (mm) | Jet. Gas Press. (kg/cm²) | Ni Particle Size (μm) | Hardness (Hv) |
|---|---|---|---|---|
| EX. 10 | 2.0 | 90 | 0.3 | 52 |
| EX. 11 | 3.0 | 70 | 0.5 | 57 |
| COMP. | | | | |
| EX. 8 | 4.0 | 15 | 6–50 | 34 |
| EX. 9 | 10.0 | 50 | 3–20 | 38 |

As seen in the above TABLE III, the composite compound materials according to the present invention have shown, respectively, a high hardness while containing substantially no Ni particles of a size larger than 1 μm. In contrast, COMPARATIVE EXAMPLE 8 was performed with a jetting gas pressure which was too low, and COMPARATIVE EXAMPLE 9 was performed too large with nozzle diameter sufficiently to lower the cooling rate, whereby the Ni particles dispersed in Ag were larger while containing larger size Ni particles of a single phase, so as not to render the hardness to be higher.

EXAMPLE 12

Ag and Ni were placed in a graphite crucible at a ratio of Ag 90 wt % and Ni 10 wt %, and were made into a melt of 1,650° C. by means of a high frequency melting. The melt was jetted out of a ruby-made nozzle of a hole diameter 120 μm under an argon back pressure of 3 kg/cm², into a water film of 4° C. formed on the inner peripheral wall of a drum of a diameter 500 mm and rotated at 300 rpm, and a powdery material of a particle size 50 to 200 μm was obtained. The powdery material was placed in a metal die kept at 400° C. to be formed as hot-pressed under a pressure of 10 ton/cm², and this formed piece was sintered in an Ar atmosphere at 850° C. for 3 hours.

The thus obtained sintered member was subjected to repetitive wire drawing by hot-extrusion at 700° C. and annealing, to be made into a wire of a predetermined thickness, and rivet-shaped contacts were obtained as joined with Cu.

EXAMPLE 13

Except for such changes in the composition ratio of the metals as shown in the following TABLE IV, an electric contact was obtained in the same manner as in EXAMPLE 12.

EXAMPLE 14

Ag and Ni were put in a graphite crucible at a ratio of Ag 90 wt % and Ni 10 wt %, and made into a melt at 1,750° C. by means of a high frequency melting. This melt was jetted out of a ruby-made nozzle of a hole diameter of 3 mm under an argon back pressure of 1 kg/cm², and thus jetted melt stream was atomized by a high pressure Ar gas at 70 kg/cm² to be rapidly cooled and solidified, and a powdery composite material was obtained. This powdery material was processed in the same manner as in EXAMPLE 12 and an electric contact was thereby obtained.

EXAMPLES 15 to 21

Except for such changes in the type of the metal B and composition ratio of the metals as listed in TABLE IV, various electric contacts were prepared in the same manner as in EXAMPLE 12.

COMPARATIVE EXAMPLE 10

A carbonyl Ni powder of less than 350 mesh and electrolytic silver powder of less than 350 mesh were mixed at a ratio of Ag 90 wt % and Ni 10 wt % in a ball mill and were formed and sintered in the same manner as in EXAMPLE 1. The thus obtained sintered body was drawn into a wire by hot-extrusion at 700° C. and then annealed. Repeating such drawing and annealing, a wire of a predetermined thickness was obtained, which was jointed with Cu, and formed into rivet-shaped contacts.

COMPARATIVE EXAMPLES 11 to 14

Except for such changes in the metal B and composition ratio of the metals as listed in TABLE IV, various electric contacts were prepared in the same manner as in EXAMPLE 12.

The respective electric contacts of the foregoing EXAMPLES 12 to 21 and COMPARATIVE EXAMPLES 10 to 14 were tested in respect of the number of welding and contact resistance, results of which tests were as listed in TABLE IV, the tests having been carried out for sample number N=3 of each contact by means of an ASTM tester. Contact opening and closing conditions were of an applied voltage of 100 V, applied current of 40 A, tripping force of 200 g, contacting force of 140 g, and repeated contact opening and closing of 50,000 times.

TABLE IV

| | Metals A:B | Content (wt %) | Welding (times) | Contact Resist. (mΩ) |
|---|---|---|---|---|
| EX. 12 | Ag:Ni | 90:10 | 20 | 0.6 |
| EX. 13 | Ag:Ni | 99:1 | 120 | 0.5 |
| EX. 14 | Ag:Ni | 90:10 | 45 | 1.0 |
| EX. 15 | Ag:Fe | 90:10 | 55 | 0.65 |
| EX. 16 | Ag:Si | 95:5 | 70 | 0.8 |
| EX. 17 | Ag:CO | 99:1 | 130 | 0.7 |
| EX. 18 | Ag:Cr | 97:3 | 80 | 0.9 |
| EX. 19 | Ag:Fe | 90:10 | 55 | 1.0 |
| EX. 20 | Ag:Rh | 97:3 | 70 | 0.4 |
| EX. 21 | Ag:V | 95:5 | 115 | 0.7 |
| COMP. | | | | |
| EX. 10 | AG:Ni | 90:10 | 200 | 1.0 |
| EX. 11 | Ag:Ni | 99.8:0.2 | 280 | 0.5 |
| EX. 12 | Ag:Ni | 75:25 | 150 | 2.5 |
| EX. 13 | Ag:Fe | 75:25 | 90 | 1.1 |
| EX. 14 | Ag:Co | 99.8:0.2 | 300 | 0.6 |

It should be appreciated that, as is clear in view of the above TABLE IV, the electric contacts of, for example, EXAMPLES 12 to 14 of the present invention have shown properties of welding and contact resistance superior to those of COMPARATIVE EXAMPLES 10 to 12, and that the contacts employing other metals than Ni for the metal B according to the present invention were also superior. In the case of the contacts according to the COMPARATIVE EXAMPLES, even the one of the mixing ratio of, for example, Ag 90 wt % and Ni 10 wt % has involved such larger Ni particles as to form 40 to 50 μm particles present scattered in the electric contact material, which caused the number of weldings to be remarkably increased.

What we claim as our invention is:

1. A composite conductive material formed by dispersing in a first matrix metal for strengthening said material a second metal which is insoluble or slightly soluble in said first matrix metal at a normal temperature, wherein said first metal is selected from the group consisting of Ag, Au and Cu, and wherein said second metal is a metal or metalloid present in said composite material in a particle size from 0.01 μm to less than 1 μm, at a ratio of 0.5 to 20 wt % of the total weight of said first matrix and second metals.

2. A material according to claim 1, wherein said first matrix metal is Ag, and said second metal is at least one member selected from a group consisting of Ni, Cr, Fe, Co, Si, Rh and V.

3. An electric contact material made of a composite conductive material comprising a first matrix metal and a second metal insoluble or slightly soluble in said first metal at a normal temperature, said second metal being dispersed in the first matrix metal, and said conductive material being made into a described shape to form said contact material, wherein said first metal is selected from the group consisting of Ag, Au and Cu, and wherein said second metal is a metal or metalloid of a particle size from 0.01 μm to less than 1 μm and is employed at a ratio of 0.5 to 20 wt % with respect to the total weight of said first and second metals.

4. A material according to claim 3, wherein said first matrix metal is Ag, and said second metal is dispersed in Ag by rapid cooling and solidification.

5. A material according to claim 4, wherein said second metal is at least one number selected from the group consisting of Ni, Cr, Fe, Co, Si, Rh, and V.

6. A composite conductive material formed by dispersing in a first matrix metal for strengthening said material, a second metal which is insoluble or slightly soluble in said first matrix metal at a normal temperature, wherein said first metal comprises Au, and wherein said second metal is at least one member selected from the group consisting of Ge, Si, Sb, and Rh, which is present in said composite material in a particle size of 0.01 microns to less than 1 micron, at a ratio of 0.5 to 20 wt. % of the total weight of said first matrix and second metals.

7. A composite conductive material formed by dispersing in a first matrix metal for strengthening said material, a second metal which is insoluble or slightly soluble in said first matrix metal at a normal temperature, wherein said first metal comprises Cu, and wherein said second metal comprises Fe and is present in said composite material in a particle size of 0.01 microns to less than 1 micron at a ratio of 0.5 to 20 wt. % of the total weight of said first matrix and second metals.

* * * * *